US006146040A

United States Patent [19]

Dunn et al.

[11] Patent Number: 6,146,040

[45] Date of Patent: Nov. 14, 2000

[54] APPARATUS AND PROCESS FOR CLEANING ARTICLES SUCH AS BABY BOTTLES

[75] Inventors: Steven B. Dunn, Beverly Hills; William B. Farnham, San Pedro; Tor H. Petterson, Rancho Polos Verdes, all of Calif.

[73] Assignee: Munchkin, Inc., Van Nuys, Calif.

[21] Appl. No.: 09/038,737

[22] Filed: Mar. 11, 1998

[51] Int. Cl.[7] ..... A47L 1/08

[52] U.S. Cl. ..... 401/138; 401/137; 401/139; 401/25; 401/27; 401/123

[58] Field of Search ..... 401/183, 6, 41, 401/25, 123, 140, 137, 138, 118, 139, 27; 15/118, 106

[56] References Cited

U.S. PATENT DOCUMENTS

| | | | |
|---|---|---|---|
| D. 4,390 | 10/1870 | Atwater . | |
| D. 222,026 | 9/1971 | Johnson . | |
| D. 245,221 | 8/1977 | Hoyt . | |
| D. 250,068 | 10/1978 | Ducotey . | |
| D. 334,845 | 4/1993 | Ricciareli et al. . | |
| D. 355,105 | 2/1995 | Nemazi . | |
| D. 387,704 | 12/1997 | Berti . | |
| 1,557,655 | 10/1925 | Cave et al. . | |
| 1,905,861 | 4/1933 | Hammes | 401/137 |
| 2,973,538 | 3/1961 | Thomson | 401/183 |
| 2,986,762 | 6/1961 | Webb | 401/139 |
| 3,130,433 | 4/1964 | John . | |
| 3,372,975 | 3/1968 | Johnson | 401/183 |
| 3,603,692 | 9/1971 | Ball | 401/139 |
| 3,943,591 | 3/1976 | Lanusse . | |
| 4,374,444 | 2/1983 | Zhadanov . | |
| 4,682,558 | 7/1987 | Broersz . | |
| 4,955,747 | 9/1990 | Tarver | 401/139 |
| 5,000,602 | 3/1991 | Kim . | |
| 5,186,563 | 2/1993 | Gebhard et al. . | |
| 5,214,820 | 6/1993 | Shumway et al. . | |
| 5,336,330 | 8/1994 | Shumway et al. . | |
| 5,596,786 | 1/1997 | Kluiters . | |
| 5,625,918 | 5/1997 | Kieson et al. . | |
| 5,746,531 | 5/1998 | Izhak | 401/139 |

FOREIGN PATENT DOCUMENTS

| | | | |
|---|---|---|---|
| 243572 | 10/1947 | Switzerland | 401/137 |

*Primary Examiner*—David J. Walczak
*Attorney, Agent, or Firm*—Knoble & Yoshida, LLC

[57] ABSTRACT

An apparatus for cleaning an article such as a baby bottle includes a handle that is sized and configured to be gripped in one hand of a user, and a reservoir defined within the handle for storing a detergent. A push-pull cap is provided on the handle for dispensing detergent from the reservoir when the handle is squeezed. A brush is connected to the handle, and is sized and configured so as to be able to fit into an open end of a baby bottle to scrub the baby bottle during cleaning. The push-pull cap is advantageously located on a portion of the handle member that is remote from the brush member, so that a user will be able to dispense detergent and scrub without putting down the apparatus, and also have the flexibility to scrub without fear of unwanted detergent leaking into the brush, such as during a final rinse. A novel brush configuration is also disclosed.

18 Claims, 3 Drawing Sheets

APPARATUS AND PROCESS FOR CLEANING ARTICLES SUCH AS BABY BOTTLES

BACKGROUND OF THE INVENTION

1. Field of the Invention

This invention pertains generally to the field of household cleaning and, in one embodiment of the invention, to infant feeding and care. More specifically, this invention relates to an improved utensil for cleaning articles such as glasses, plates and infant nursing bottles that is more effective, efficient and attractive than articles that are presently available for similar purposes.

2. Description of the Related Technology

The importance of proper hygiene when handling and cleaning eating utensils such as baby bottles cannot be overstated. Ideally, bottles should be thoroughly scrubbed with detergent, then sterilized by immersion in boiling water between uses. Proper scrubbing is especially important after a bottle has been used to dispense fatty liquids, or liquids having suspended solids therein, such as cereal.

Brushes that are equipped with built-in reservoirs for storing detergent are well represented in the literature. Such brushes are constructed so that detergent is squeezed or gravity fed directly into the bristles of the brush when the handle of the brush is compressed. Although convenient in the sense that the need for a separate bottle of detergent is eliminated, these articles present several difficulties in practice. First, it is difficult to accurately dispense the correct amount of soap, because the brush bristles obscure view of the soap. Second, it is almost impossible to rinse the brush free of soap when, for example, it is desired to scrub while rinsing, because soap continues to flow into the brush. Even a single drop of unwanted detergent in a brush is problematic during rinsing, because detergent tends to be quite concentrated.

To scrub most effectively, the cleaning surfaces of the brush should be pressed firmly against the inside wall of a baby bottle. The larger the brush, the more such scrubbing pressure tends to be created when the brush is constrained to within the bottle. Unfortunately, articles such as baby bottles have relatively narrow necks, and the brush must be passed through the neck to fit into the bottle. This effectively limits the size of the brush.

A need exists for an improved cleaning apparatus that can dispense detergent, yet that can also be used to scrub articles when no detergent is desired. A need also exists for a cleaning apparatus that can generate expansive force for scrubbing against the wall of the bottle when it is positioned within the bottle, yet can pass easily through the neck of the bottle for insertion and removal.

SUMMARY OF THE INVENTION

Accordingly, it is an object of the invention to provide an improved cleaning apparatus, for articles such as baby bottles, that can dispense detergent, yet that can also be used to scrub and rinse when no detergent is desired.

It is further an object of the invention to provide a cleansing brush that can generate expansive force for scrubbing against the wall of the bottle when it is positioned within the bottle, yet can pass easily through the neck of the bottle for insertion and removal.

In order to achieve the above and other objects of the invention, an apparatus for cleaning an article includes, according to a first aspect of the invention, a handle member that is sized and configured to be gripped in one hand of a user, the handle member having a reservoir defined therein for storing a detergent, and dispensing structure for dispensing detergent from the reservoir; a brush member connected to the handle member; and wherein the dispensing structure is located on a portion of the handle member that is remote from the brush member, whereby a user will be able to dispense detergent and scrub without putting down the apparatus, and also have the flexibility to scrub without fear of unwanted detergent leaking into the brush member, such as during a final rinse.

According to a second aspect of the invention, an apparatus for cleaning an article having an interior chamber and an opening that is in communication with the chamber includes a handle member; and a brush member connected to the handle member, the brush member being sized and configured to fit into the opening to scrub the baby bottle during cleaning, the brush member including a plurality of compressible wiper portions that are constructed and arranged to engage and wipe inside surfaces of the article during cleaning, and that are compressible enough to minimize interference when the brush member is inserted into the opening before cleaning.

According to a third aspect of the invention, a method of cleaning an article includes steps of: (a) holding in one hand an apparatus for cleaning an article; (b) introducing detergent into the article from a first portion of the apparatus; (c) scrubbing the article with a second portion of the apparatus that is different from the first portion; and (d) rinsing the article.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
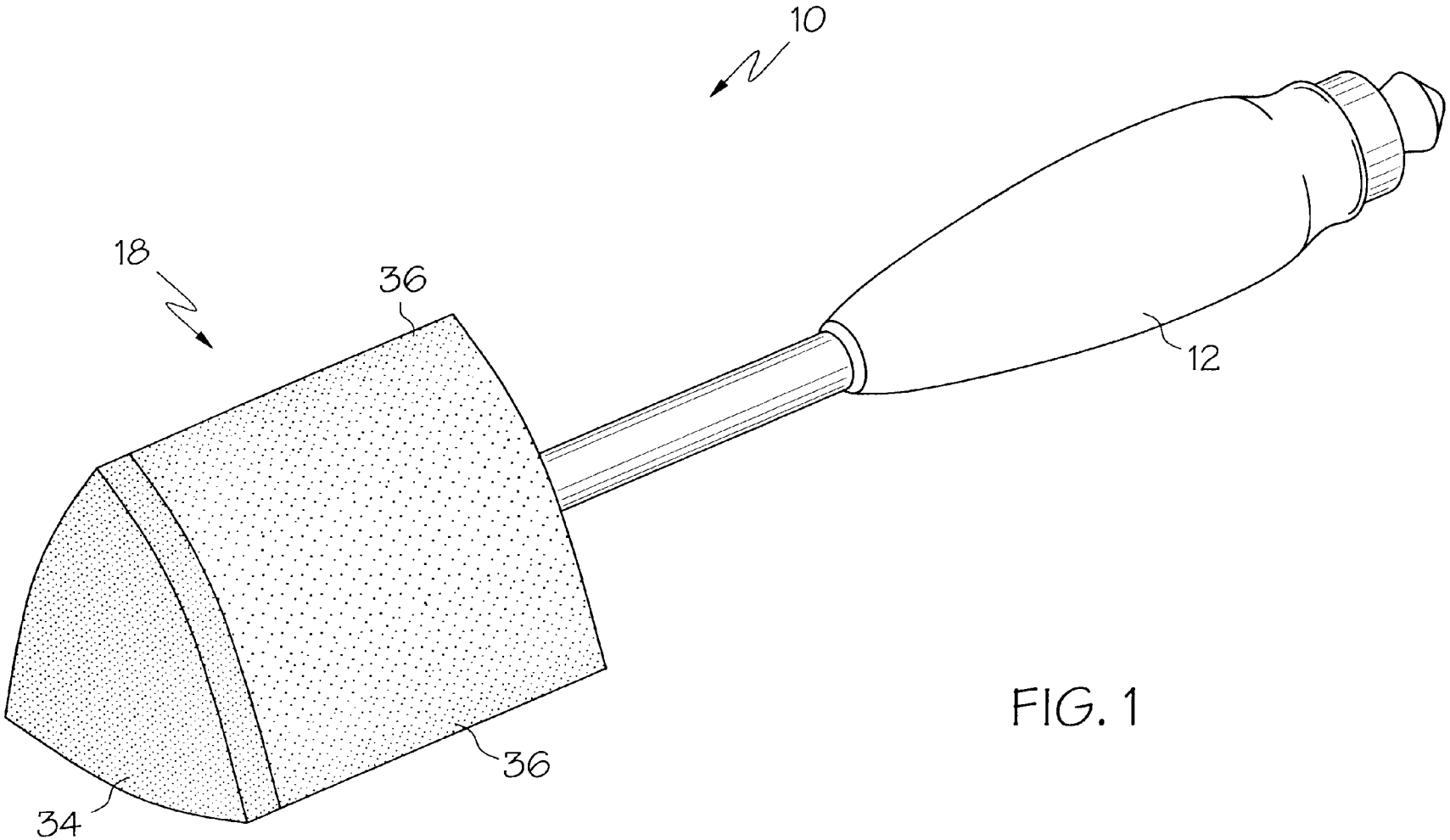
FIG. 1 is a perspective view of an apparatus that is constructed according to a preferred embodiment of the invention.

Referring now to the drawings, wherein like reference numerals designate corresponding structure throughout the views, and referring in particular to FIG. 1, an apparatus 10 for cleaning an article such as a baby bottle that is constructed according to a preferred embodiment of the invention includes a handle member 12 that is sized and configured to be gripped in one hand of a user. Handle member 12 has a reservoir 14 defined therein (best-shown in FIG. 2) for storing a detergent, and dispensing structure 16 for dispensing detergent from the reservoir.

Figure 2:
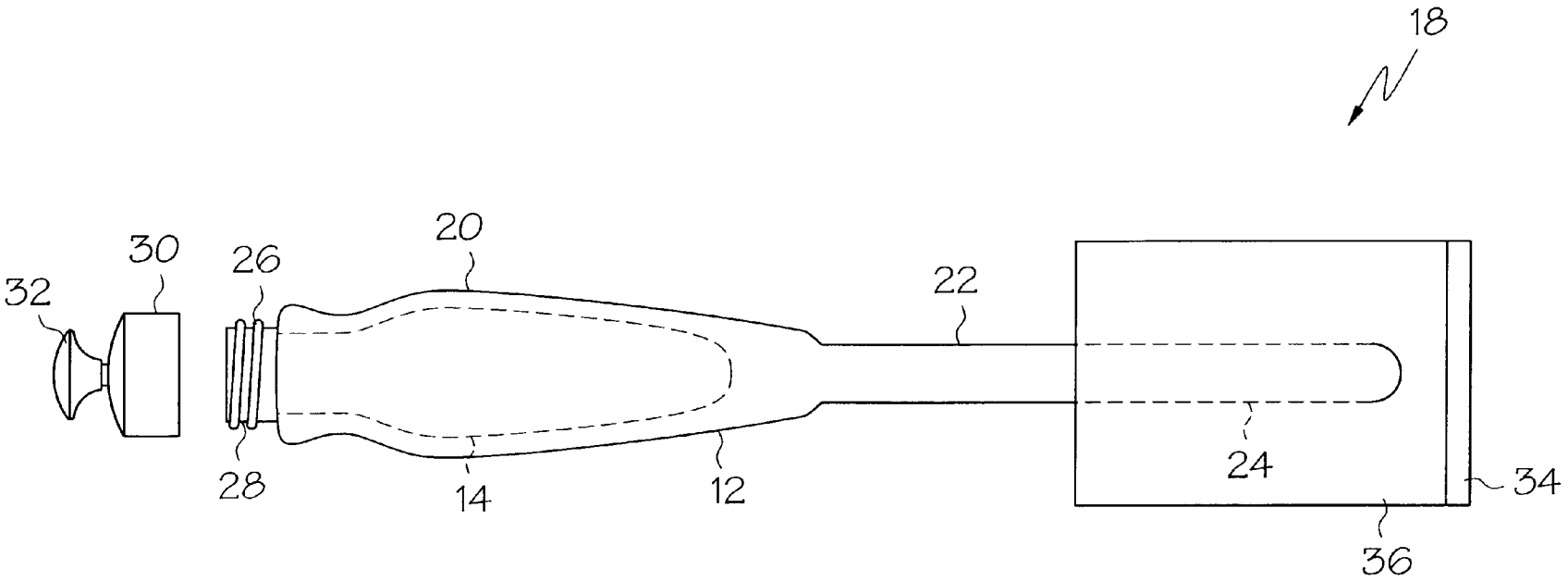
FIG. 2 is a diagrammatical side elevational view of the apparatus of FIG. 1.

As may be seen in FIGS. 1 and 2, a brush member 18 is connected to handle member 12. Handle member 12 is preferably embodied so as to have a main body portion, which houses the reservoir 14, and an elongated boss portion 22. Brush member 18 is secured to the elongated boss portion 22 by a suitable waterproof adhesive, although alternative securing structure could be used within the scope of the invention.

The dispensing structure 16 is located on a portion of the handle member 12 that is remote from the brush member 18, so that a user will be able to dispense detergent and scrub without putting down the apparatus, and also have the flexibility to scrub without fear of unwanted detergent leaking into the brush member 18, such as during a final rinse. In the illustrated embodiment, mounting the dispensing structure 16 on the handle member 12 so that it is substantially opposed to the brush member 18 effects this.

In the preferred embodiment, the dispensing structure 16 includes a finish portion 26 defined on the handle member 12 that is similar to the finish on, for example, a bottle of dishwashing detergent. An external thread 28 is defined on the finish portion 26, and a common push-pull dispensing cap 30 having a plunger nozzle 32 is threaded onto the finish portion 26, as may best be seen in FIG. 2.

Brush member 18 is sized and configured to be able to fit into an open end of a baby bottle to scrub the baby bottle during cleaning, and includes a scouring portion 34 for scouring dried-on material, such as dried milk, from the bottom and side inside surfaces of the bottle. Scouring portion 34 is fabricated from a commercially available known material that is suitable for such purposes, such as 7445 light duty cleansing pad, available from 3M Corporation of St. Paul, Minn. The brush itself is preferably made from a compressible, water-absorbing sponge-like material such as reticulated polyester. In the most preferred embodiment, the sponge-like material is 30 pores per inch reticulated polyester. Other known materials could alternatively be substituted within the scope of the invention.

Figure 3:
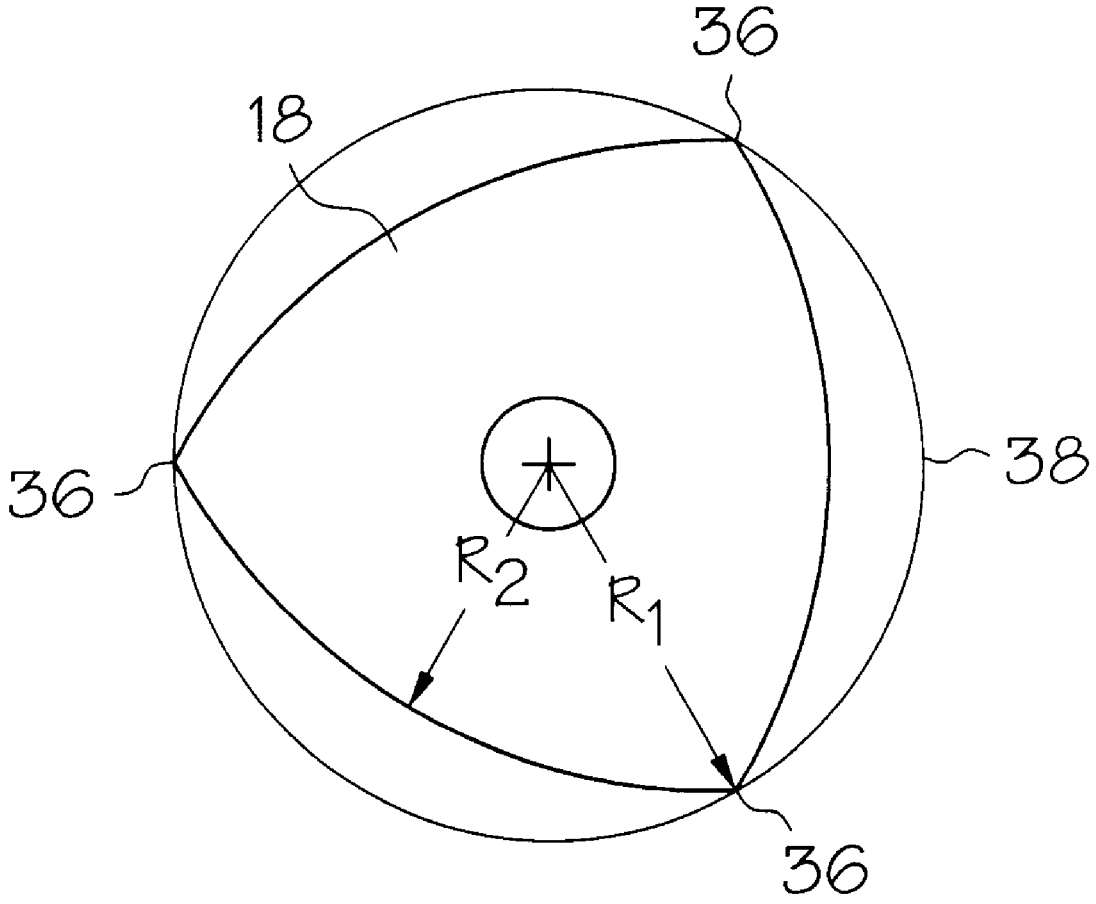
FIG. 3 is a diagrammatical view depicting a method of cleaning a baby bottle according to a preferred mode of the invention.

According to one particularly advantageous feature of the invention, and as best shown in FIGS. 2 and 3, the brush member 18 includes a plurality of axially extending compressible wiper portions 36 that are constructed and arranged to engage and wipe inside surfaces of a bottle during cleaning. As shown in FIG. 3, the compressible wiper portions 36 are preferably spaced substantially evenly with respect to each other about a periphery of the brush member 18 so as to center the brush member 18 within the bottle during cleaning. In the illustrated embodiment, brush member 18, includes three such compressible wiper portions 36, the wipers 36 are unitary with and constructed of the same material as the rest of brush 18. When viewed on a plane that is perpendicular to the longitudinal axis of the apparatus 10, as for example in FIG. 3, brush member 18 and the three compressible wipers has the appearance of a triangle that has slightly convex sides, with the edges or tips of the wipers being the vertices of the triangle. The radial distance $R_1$ from the center axis of the brush member 18 to the end of one of the wipers 36 preferably exceeds the radial distance $R_2$ from the center axis of the brush member 18 to the closest portion of the side of the brush 18 by an amount of at least 3 millimeters, with a preferred value of at least 5 millimeters. In the most preferred embodiment, the value is about 7 millimeters.

By the presence of the wipers and the triangular cross-section described above, brush member 18 exerts expansive pressure against the inside surface 38 of the bottle during cleaning, yet is flexible enough to minimize interference when the brush member is inserted or withdrawn through the neck of the bottle. In addition, the presence of the compressible wipers can define gaps or openings between brush member 18 and the inside surface 38 of the bottle during cleaning, which will allow water to flow from one end of the brush member to the other when the brush member is moved axially within the bottle. This creates a turbo or washing action within the bottle during scrubbing or rinsing. This washing action, especially when considered in view of the scrubbing pressure that is created by the expansive action of the wipers 36 against the inside surface 38 of the bottle, is very effective at cleaning the interior of the bottle, especially when cleaning up difficult, dried-on messes.

In operation, a user will cleanse an article such as a baby bottle according to a preferred mode of the invention by first holding in one hand an apparatus for cleaning baby bottles. The user will then open the push-pull cap 30 and then invert his or her wrist, without changing the position of the apparatus 10 in his or her hand, to squeeze the desired amount of detergent out of the reservoir 14 in to the bottle. The push-pull cap is then closed, and by reinverting his or her wrist, the user can then insert the brush member portion 18 into the bottle (with a minimal amount of resistance, due to the flexibility of the brush member 18) and scrub the inside of the bottle. The bottle can then be rinsed, and, if desired, scrubbed while rinsing without fear of soap being inadvertently reintroduced. The entire operation can be performed without releasing the apparatus from the one hand, which is a welcome convenience for a busy caregiver.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for cleaning a baby bottle, comprising:

a handle member that is sized and configured to be gripped in one hand of a user, the handle member having a longitudinal axis and also a reservoir defined therein for storing a detergent, and dispensing means for dispensing detergent from the reservoir;

a brush member connected to the handle member, said brush member also having a longitudinal axis that is substantially parallel to said longitudinal axis of the handle member wherein said brush member has a length along said longitudinal axis of the brush member which is longer than a width of said brush member taken along an axis which is perpendicular to said longitudinal axis of the brush member, said brush member further including a plurality of compressible wiper portions that are constructed and arranged to engage and wipe inside surfaces of a container during cleaning wherein each of said wiper portions comprising a compressible linear edge that is substantially parallel to said longitudinal axis of the brush member and protruding radially outwards of said longitudinal axis of the brush member, said linear edges; and wherein the dispensing means is located on a portion of the handle member that is remote from the brush member, whereby a user will be able to dispense detergent and scrub without putting down the apparatus, and also have the flexibility to scrub without fear of unwanted detergent leaking into the brush member, such as during a final rinse.

2. An apparatus according to claim 1, wherein the handle member comprises a main body portion that is sized and configured to be gripped in one hand of a user, and an elongated boss portion, and wherein the brush member is secured to the elongated boss portion.

3. An apparatus according to claim 2, wherein said brush member is secured to said elongated boss portion by a waterproof adhesive.

4. An apparatus according to claim 1, wherein said dispensing means is mounted on said handle member so as to be substantially opposed to said brush member.

5. An apparatus according to claim 1, wherein said dispensing means comprises a push-pull dispensing cap.

6. An apparatus according to claim 1, wherein said dispensing means comprises a threaded finish portion that is integral with said handle member; and a dispensing cap that is threaded on to said finish portion.

7. An apparatus according to claim 6, wherein said dispensing cap is a push-pull dispensing cap.

8. An apparatus according to claim 1, wherein said brush member further comprises a scouring portion for scouring during cleaning.

9. An apparatus according to claim 1, wherein said compressible wiper portions are spaced substantially evenly with respect to each other about a periphery of the brush member so as to center the brush member within the baby bottle during cleaning.

10. An apparatus according to claim 1, wherein said brush member includes three compressible wiper portions.

11. An apparatus according to claim 1, wherein said compressible wiper portions extend radially outwardly from adjacent portions of said brush member by a distance of at least three millimeters.

12. An apparatus according to claim 1, wherein said brush member is fabricated from a sponge-like material.

13. An apparatus for cleaning a baby bottle of the type that has an interior space and an opening that is in communication with the interior space, comprising:

a handle member having a longitudinal axis; and a brush member connected to said handle member, said brush member being sized and configured to fit into the opening to scrub the interior of the baby bottle during cleaning, said brush member including a plurality of axially extending compressible wiper portions each of which has an outer edge that extends in a direction that is substantially parallel to said longitudinal axis of said handle member wherein when said brush member is viewed on a plane that is perpendicular to said longitudinal axis of the handle member, said brush member has the appearance of a triangle that has three slightly convex sides whereby said brush member is constructed and arranged to engage and wipe inside surfaces of the baby bottle during cleaning, and being compressible enough to minimize interference when the brush member is inserted into the opening before cleaning.

14. An apparatus according to claim 13, wherein said compressible wiper portions are spaced substantially evenly with respect to each other about a periphery of the brush member so as to center the brush member within the baby bottle during cleaning.

15. An apparatus according to claim 13, wherein said brush member includes three compressible wiper portions.

16. An apparatus according to claim 13, wherein said compressible wiper portions extend radially outwardly from adjacent portions of said brush member by a distance of at least three millimeters.

17. An apparatus according to claim 13, wherein said brush member is fabricated from a sponge-like material.

18. An apparatus according to claim 1, wherein said dispensing means is constructed and arranged to be operated with use of only one hand.

* * * * *